US008754314B1

(12) United States Patent
Bachman, III

(10) Patent No.: US 8,754,314 B1
(45) Date of Patent: Jun. 17, 2014

(54) REMOTE ACTIVATED PERCUSSION DEVICE

(76) Inventor: William S. Bachman, III, Nashville, TN (US)

( * ) Notice: Subject to any disclaimer, the term of this patent is extended or adjusted under 35 U.S.C. 154(b) by 46 days.

(21) Appl. No.: 12/724,330

(22) Filed: Mar. 15, 2010

Related U.S. Application Data

(60) Provisional application No. 61/160,550, filed on Mar. 13, 2009.

(51) Int. Cl.
*G10D 13/02* (2006.01)

(52) U.S. Cl.
USPC ..... 84/422.3; 84/422.1

(58) Field of Classification Search
USPC ..... 84/422.3
See application file for complete search history.

(56) References Cited

U.S. PATENT DOCUMENTS

| | | | | |
|---|---|---|---|---|
| 3,167,995 | A * | 2/1965 | La Londe | 84/421 |
| 6,054,645 | A * | 4/2000 | Gauger | 84/422.3 |
| 7,288,708 | B1 * | 10/2007 | Kassabian | 84/422.1 |
| 7,342,163 | B2 * | 3/2008 | O'Donnell | 84/422.3 |

* cited by examiner

*Primary Examiner* — Christopher Uhlir
(74) *Attorney, Agent, or Firm* — Waddey & Patterson, P.C.; Ryan D. Levy

(57) ABSTRACT

A remote activated percussion device with a pedal section having a foot pedal and a connection for a pulley element; a support section having an at least partially hollow shaft and a connection for a pulley element, the support section for supporting a pair of cymbals; a transfer section having a brace, a first pulley element and a second pulley element, the first pulley element having a connector for connecting to the connection for a pulley element on the pedal section and the first pulley element having a brace connector, the second pulley element having a connector for connecting to the connection for a pulley element on the transfer section and the second pulley element having a brace connector, and a cable engaging the pedal section, transfer section and support section for activating the pair of cymbals while providing a remote distance.

15 Claims, 16 Drawing Sheets

REMOTE ACTIVATED PERCUSSION DEVICE

The present application is a continuation of and claims benefit of our U.S. provisional patent application Ser. No. 61/160,055, entitled "Remote Activated Hi-Hat" filed Mar. 13, 2009 and is hereby incorporated by reference.

BACKGROUND OF THE INVENTION

1. Technical Field

The present invention relates to a cymbal device for improving an individual's capacity to play the drums. More particularly, the present invention relates to hi-hat types of cymbals where two opposing cymbals can be played with the foot or handheld implement with greater speed and precision at a remote location relative to the pedal while drumming. The invention includes optional embodiments for both the inventive device and the process for assembling the device.

2. Background Art

Drum kits have been around since approximately the early 1900's and are conventionally utilized in a wide variety of types of musical styles. Generally, a drum kit is defined as a collection of drums, cymbals and optionally other percussion instruments such as triangles or tambourines which may be arranged for the play by a single individual. The individual items of a drum set may be struck or contacted by a variety of different drumming implements including different types of drum sticks, mallets, brushes and other devices used to create sounds from the set. In comprising a general drum kit, the set generally includes at least a bass drum, a floor tom, tom toms, a snare drum, a crash cymbal, a ride cymbal and hi-hat cymbals. Both the bass drum and the hi-hat cymbals of a drum set may be activated through the use of foot operated pedals, where the hi-hat may also be struck by a drum stick or other hand held implement.

For the drum set to be utilized in various music genres, the drum kit may adapted by either the addition or subtraction of various components so that the desired components are available to create the necessary music. Further factors influence the design of a drum kit which may include the personal preferences of the musician as well as logistic constraints in placing each individual component of the kit. As drum kits have evolved, there has been the increased desire to orient different components in a manner so that commonly used components are more easily accessible, yet unfortunately due to the size of each of the different components, quite often certain components have to be placed at inconvenient locations.

One such component of a drum kit that is occasionally moved based upon the user's preference is the hi-hat. Generally the hi-hat is defined as a type of cymbal including two cymbals that are mounted on one stand which may be clashed together using a foot pedal. Conventionally, a pedal is attached to a stand and a rod runs through both cymbals within a hollow tube and connects to a pedal. The top cymbal may be connected to the rod while the bottom cymbal remains stationery allowing an individual to clash the cymbals by depressing the foot pedal. Drummers often strike the hi-hat with the drum sticks or other hand held implements in either the closed or gapped position depending on the desired sound the drummer wishes to create from the hi-hat.

In the standard drum set arrangements, the hi-hat is placed on the left side of the drummer and is activated with the drummer's left foot. Most often, drummers cross their hands using their dominant right hand for the more physically demanding hi-hat music while the left hand is constricted to the snare drum with this technique. Other drummers have moved the hi-hat so that their hands do not cross and they play the hi-hat with the left drum stick, right drum stick or both; however, moving the hi hat in this manner generally requires a compromise of foot pedal location, hand position and ease of play.

In an effort to provide more mobility and options for placement of the hi-hat, developments have been created so that the hi-hat may be activated but yet be positioned in different locations while still being activated by the drummer's left foot. However, most efforts preclude greater finesse of play and limit the capabilities of drummers as the timing must be shifted and the drumming rate slowed. Furthermore, attempts to relocate the pedal from the base of the high hat often require significantly greater effort in activating the top cymbal of the hi-hat against the bottom cymbal, thus again necessitating a change in the drummer's typical method of drumming.

What is desired, therefore, is a remote hi-hat with a quick action having a fast recoil/reset time, thus allowing for a much greater finesse of play and improved musical opportunities. In addition, there is a need for a remote hi-hat device so that the hi-hat cymbals may be located further from the foot activated pedal, thus allowing for the hi-hat cymbals to be placed so that the right hand of the drummer does not have to cross over the left hand to play the hi-hat.

Further desired is a remote hi-hat which provides a pedal that may be easily activated by a drummer's foot shifting off the bass or double bass pedals and activating the hi-hat in a manner similar to a traditional hi-hat, not having remote features, while providing the drummer the realized freedom for the left hand to have a full range of motion.

BRIEF SUMMARY OF THE INVENTION

The present invention provides a remote activated percussion device having a unique design to provide for improved performance in functioning as the hi-hat. In optional embodiments of the invention, the device may include hardware connecting a foot pedal so that the foot pedal remotely activates the movable top cymbal of the hi-hat to contact the top cymbal against a fixed bottom cymbal. In further optional embodiments, the foot pedal of the present invention may be set in the generally standard location for a drum set for activation by the left foot while the cymbal portion may be positioned in different locations, thus allowing for an organization of the drum set in a more ergonomical arrangement.

Optional embodiments of the device allow for the hi-hat cymbals to be placed in a location other than directly above the foot pedal which is generally played by the left foot of a drummer with a standard straight hi-hat stand. As the invention allows for hi-hat cymbals to be placed so that the right hand of a drummer would not necessarily need to cross over the left hand of the drummer to play the hi-hat when seated behind the drums, the left hand may play with larger range of motion thus possibly providing for new drumming options. Furthermore, a player's range of motion may be increased on the left side of the player's body so that further percussive instruments may be located within easy reach as the hi-hat cymbals would likely not have to occupy the typical footprint on the left side of the drummer.

Optional embodiments of the invention provide for hi-hat cymbals that can be activated in a different manner, which may provides for a quicker action and less resistance when activating with a fast recoil/reset time for improved finesse and speed of play.

In optional embodiments of the invention, the device may include multiple components roughly characterized as the pedal section, transfer section and support section. In further optional embodiments one or more of the sections may be absent or altered. Generally, in optional embodiments having a pedal section, the section may comprise any pedal known in the art for use with a hi-hat cymbal or the like and further includes an attachment for a cable or rod so as to activate the cymbals. The transfer section also called the brace section, may in optional embodiments provide for the transfer of energy from the foot pedal to the support section for activation of a cymbal or cymbals, including hi-hat cymbals and thus may allow for a foot pedal to be distally located from the stand having the hi-hat cymbals. In a variety of optional embodiments, the transfer section may provide adaptability and/or customization of many lengths and size choices for the drummer in having the foot pedal located distally from the support section to create a remote distance. The transfer section may be connected to the cymbal section and may provide a connection for the transfer of energy from the foot pedal to the cymbals maintained by the support section with a cable or the like generally being used for the activation of the top cymbal against the bottom cymbal of the hi-hat.

An optional object of the invention, therefore, is a remote activated percussion device which may include hi-hat cymbals.

Still another optional object of the invention is a remote activated percussion device providing for quick activation and recoil/reset time.

Yet another optional object of the invention is a remote activated percussion device providing for the use of pulleys and cable for activating the cymbals.

A further optional object of the invention is a method of assembling a remote activated cymbal for a remote distance so that a drummer has greater options in organizing a drum kit which may provide for a greater freedom in using both hands while drumming.

These aspects and others have become apparent to the skilled artisan upon review of the following description can become accomplished by providing a remote activated device which may include a foot pedal, brace portion and cymbal portion so that such device may provide for the cymbals to be located a distance from the foot pedal. The device may additionally provide for multiple adjustments so that the foot pedal may be moved closer or further from the hi-hat cymbals which may allow for the general customization by the user.

Aside from the structural and procedural arrangements set forth above, the invention could include a number of other arrangements, such as those explained hereinafter. It is to be understood, that both the foregoing description and the following description are exemplary.

BRIEF DESCRIPTION OF THE DRAWINGS

The accompanying drawings are incorporated in and constitute a part of this specification. The drawings illustrate optional embodiments of the invention and together with the description serve to explain some principles of the invention.

Reference will now be made in detail to optional embodiments of the invention, examples of which are illustrated in accompanying drawings. Whenever possible, the same reference numbers are used in the drawing and in the description referring to the same or like parts.

DETAILED DESCRIPTION OF THE PREFERRED EMBODIMENTS

Figure 1A:
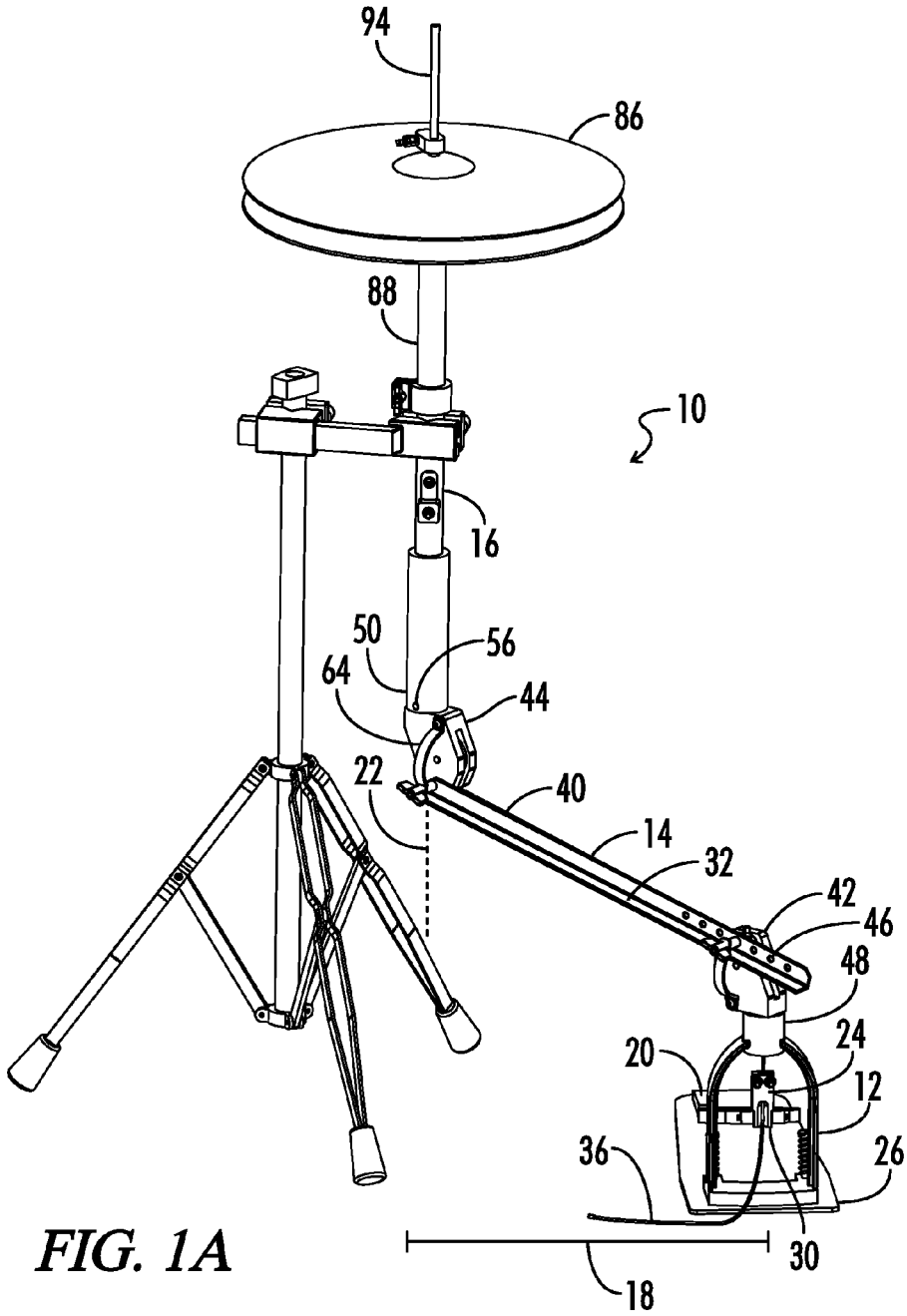
FIGS. 1*a-d* are illustrations of an optional embodiment of a remote activated percussion device of the present invention.

As used herein, the term "drum kit" is generally defined as a set of drums, cymbals and sometimes other percussion instruments arranged typically for a single drummer.

A "cymbal" is a metallic, generally round shaped percussion instrument which may be struck by the drummer or activated by a foot pedal.

A "hi-hat" is a type of cymbal generally consisting of two cymbals mounted on a stand, one on top of the other which may be clashed together using a pedal or further may be struck by the drummer.

A "stand" as used herein in reference to a hi-hat, hi-hat cymbals, or any combination of the present invention, and is another term for the portion of the hi-hat maintaining the cymbals which connects to the brace of the present invention. Notably, the stand may include a full stand arrangement wherein the stand supports the hi-hat cymbals with legs on the floor, or alternatively may only comprise a shaft with an attachment point for joining to an additional part of the drum set, with the stand not having legs.

The term "remote" as used herein is understood to mean separated or apart from beneath the cymbals or spaced from a position directly beneath the cymbals.

The terms "recoil time" or "reset time" are used herein interchangeably and refer the time required for a hi-hat cymbals to separate before regaining the option to be clashed together again by a foot pedal after having been activated immediately previous by a foot pedal.

The term "activation time" is used herein to refer to the time period between depressing the foot pedal and the cymbals clashing together.

The term "pedal" as used herein refers any type of lever designed for operation by a user's foot.

The term "providing", and forms thereof, are used in a broad sense, and are referred to, but are not limited to, making available for use, enabling usage, giving, supplying, obtaining, getting hold of, acquiring, making ready for use, and/or placing into position ready for use.

As shown in the accompanying illustrations there are multiple optional embodiments of remote activated percussion device 10. In optional embodiments of the invention, remote activated percussion device 10 may include pedal section 12, transfer section 14, and support section 16. In further optional embodiments of the invention, the invention may include lesser components so that a user may utilize pre-existing components with the invention to provide for a remote activated percussion device as described herein.

An optional embodiment may include support section 16 and transfer section 14 with the user providing a foot pedal for incorporation therewith. Other optional embodiments may include the necessary hardware to adapt a variety of various foot pedal devices with transfer section 14 for assembly of a remote activated percussion device. For purposes of illustrating the invention, many of the optional embodiments will be described with pedal section 12, transfer section 14 and support section 16. However, one should understand that the invention in optional embodiments could include only a transfer section with pulley units and a brace which may be adapted to other available hardware. Such discussion is in no way limiting and other optional embodiments exist of lesser sections of the invention.

Figure 1B:
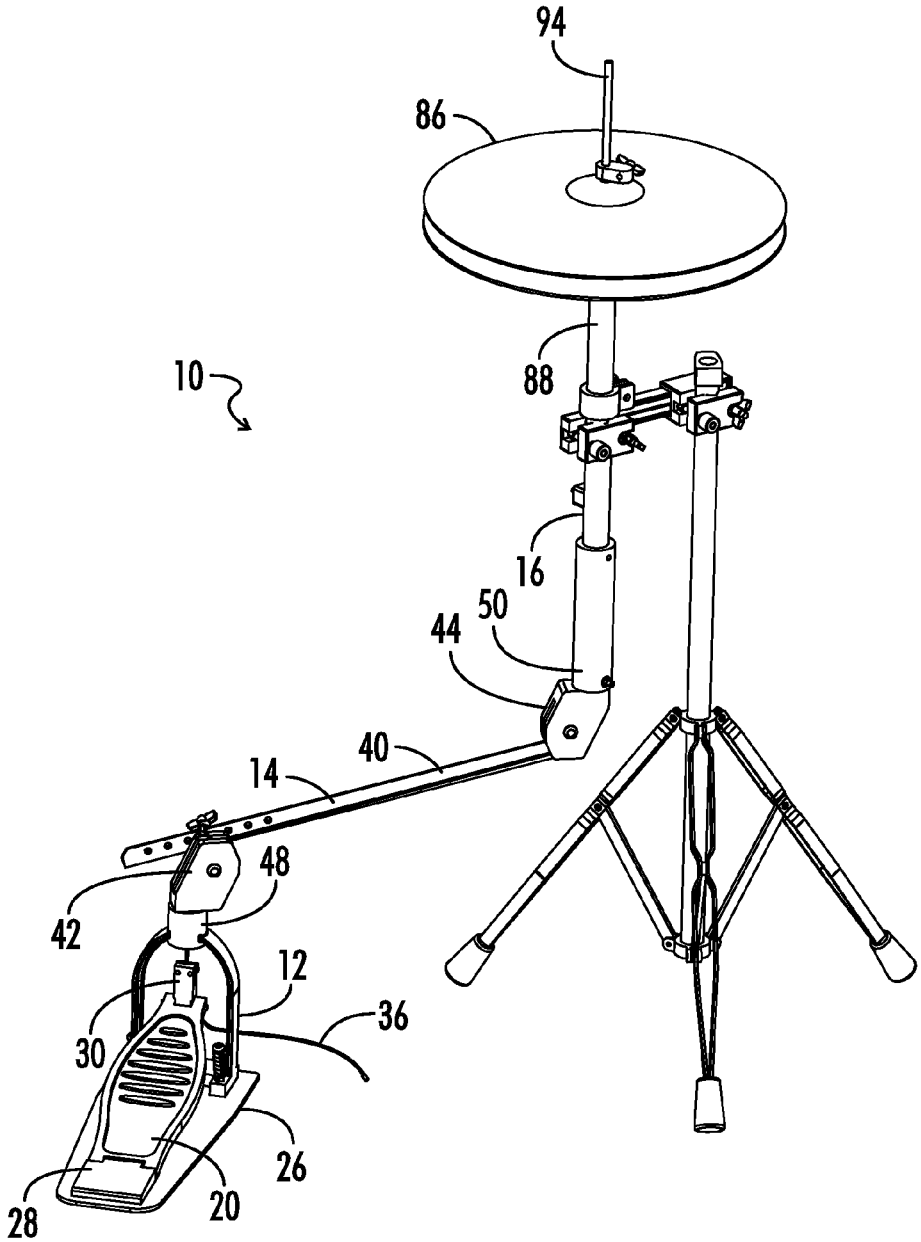
Figure 1C:
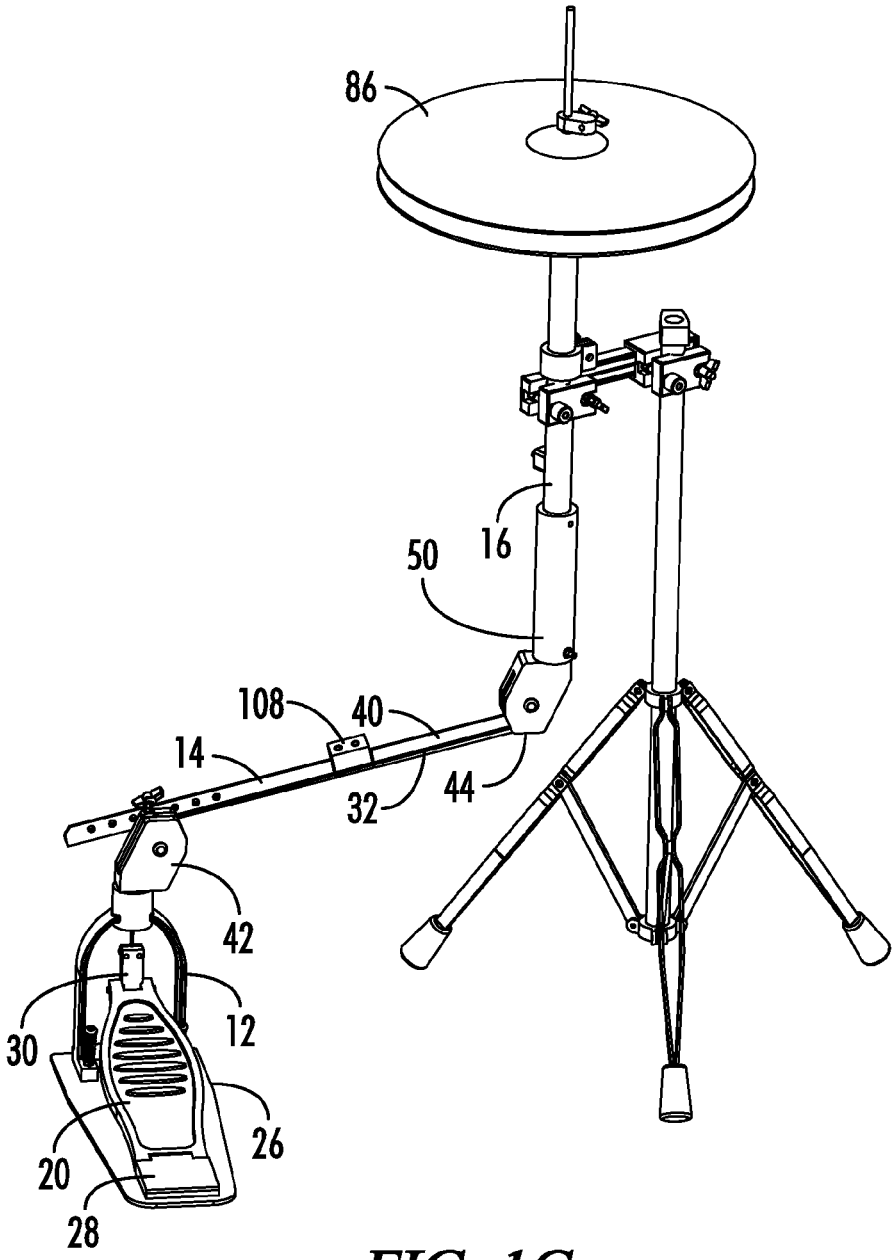
Figure 1D:
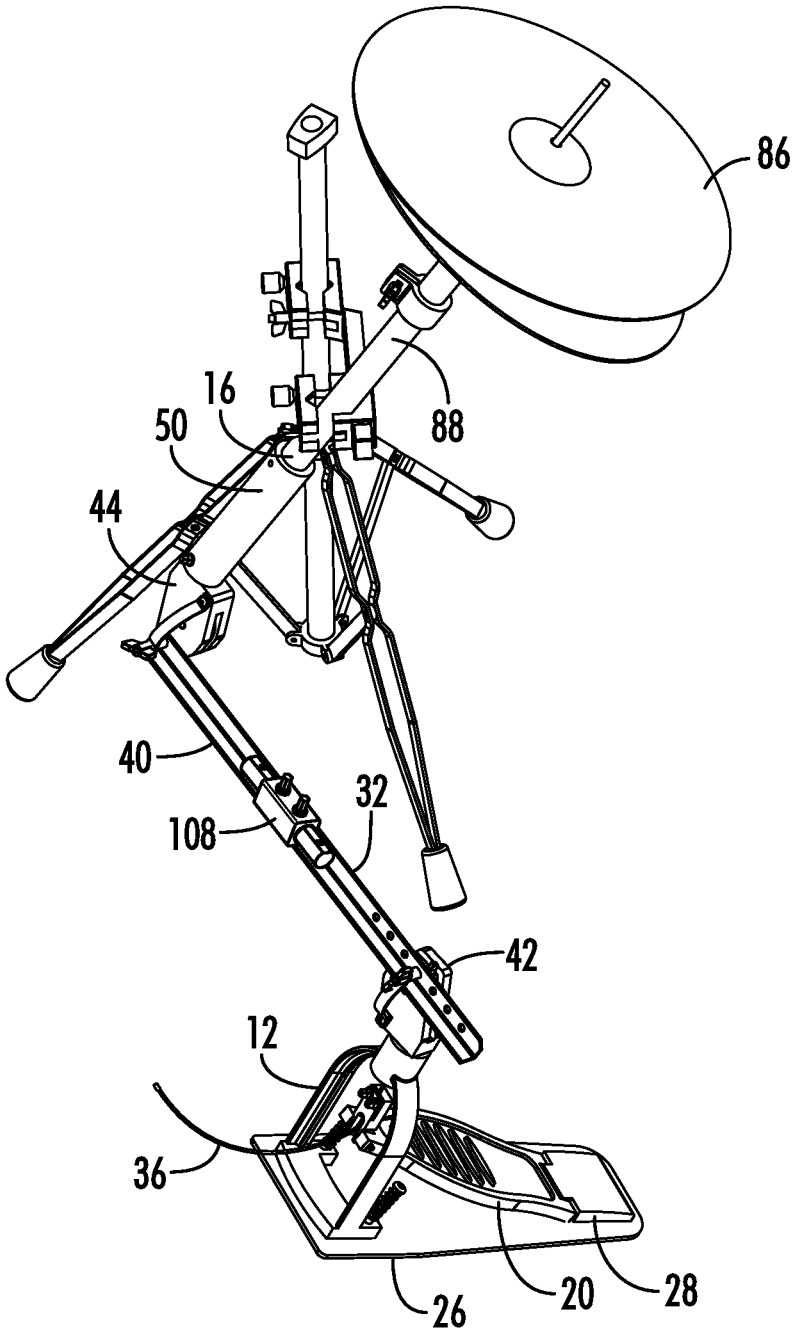
Figure 2A:
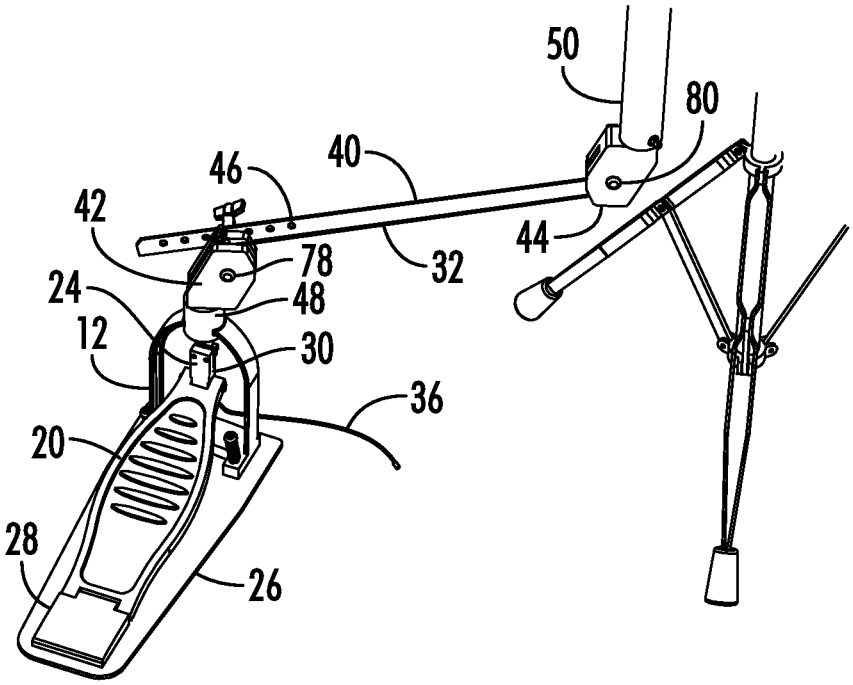
FIGS. 2*a-b* are illustrations of optional embodiments of a pedal section of a remote activated percussion device of the present invention.
Figure 2B:
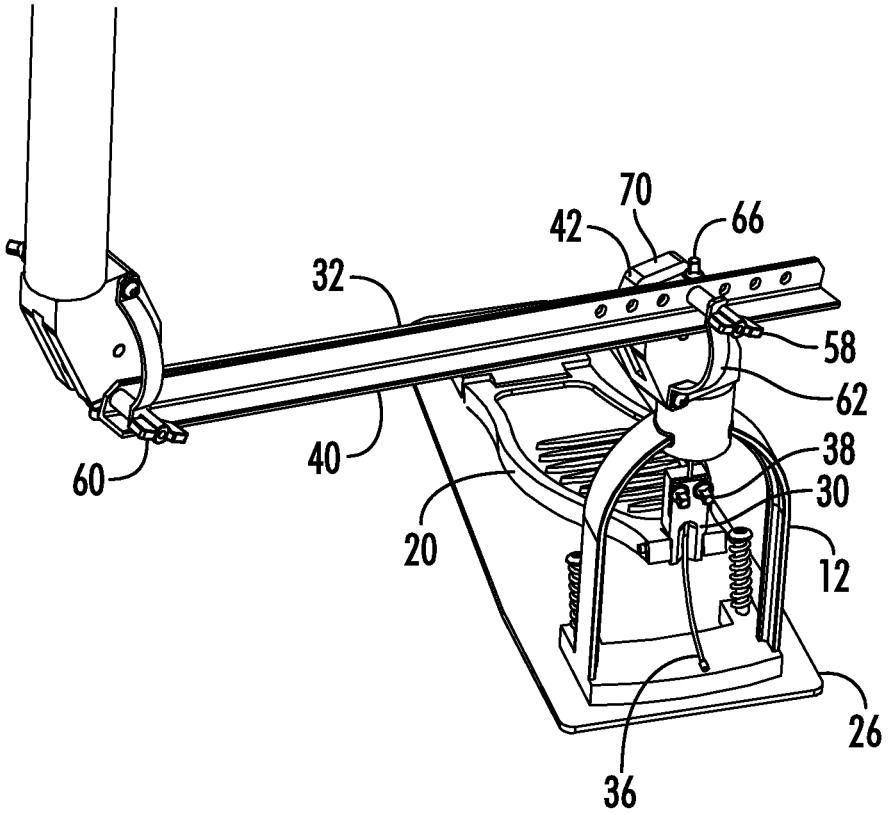
Figure 3:
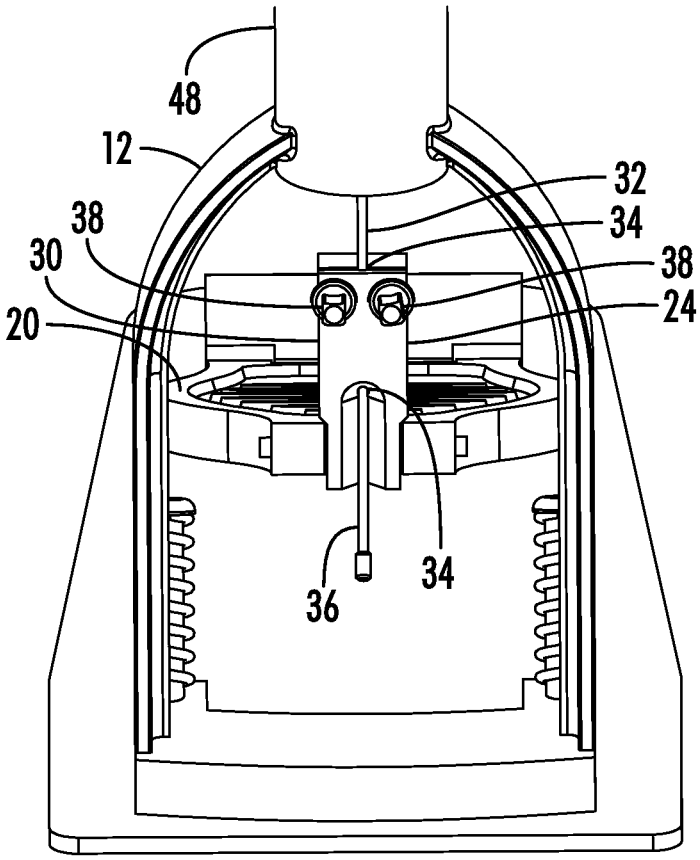
FIG. 3 is an illustration of an optional embodiment of a clamp of the pedal cable attachment of a remote activated percussion device of the present invention.
Figure 4A:
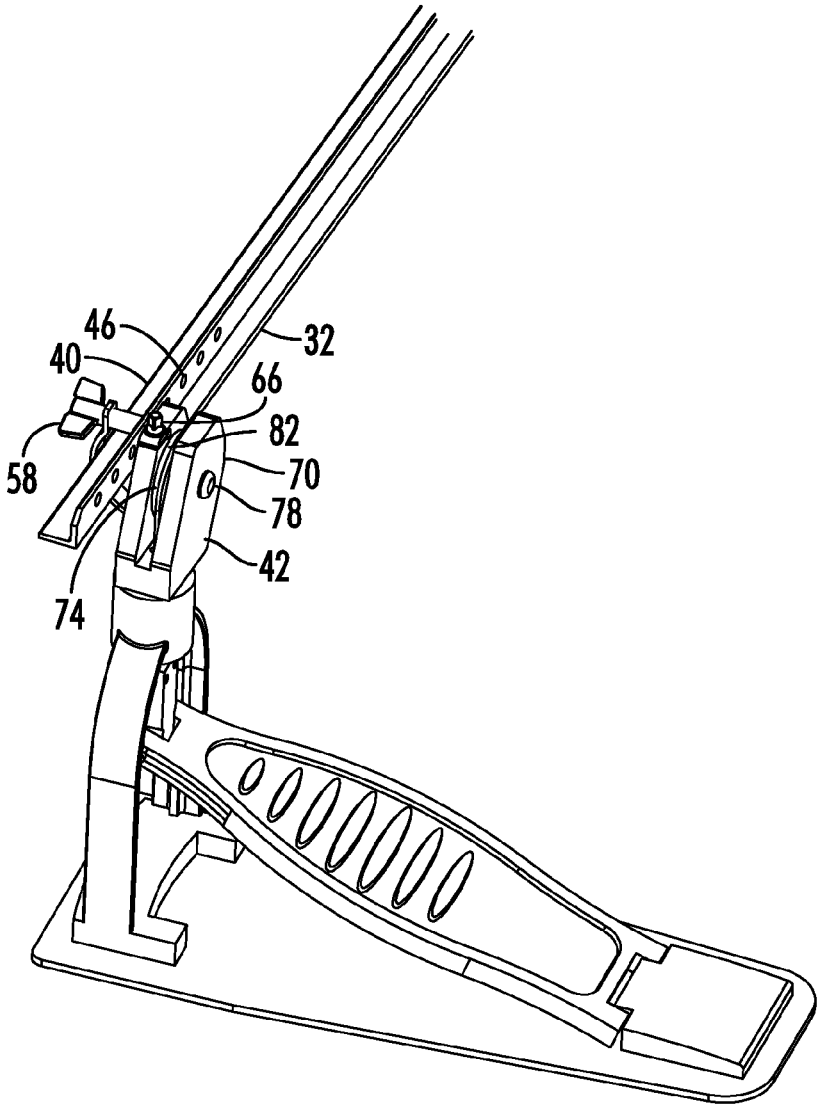
FIGS. 4*a-c* are illustrations of optional embodiments of pulley elements of a remote activated percussion device of the present invention.
Figure 4B:
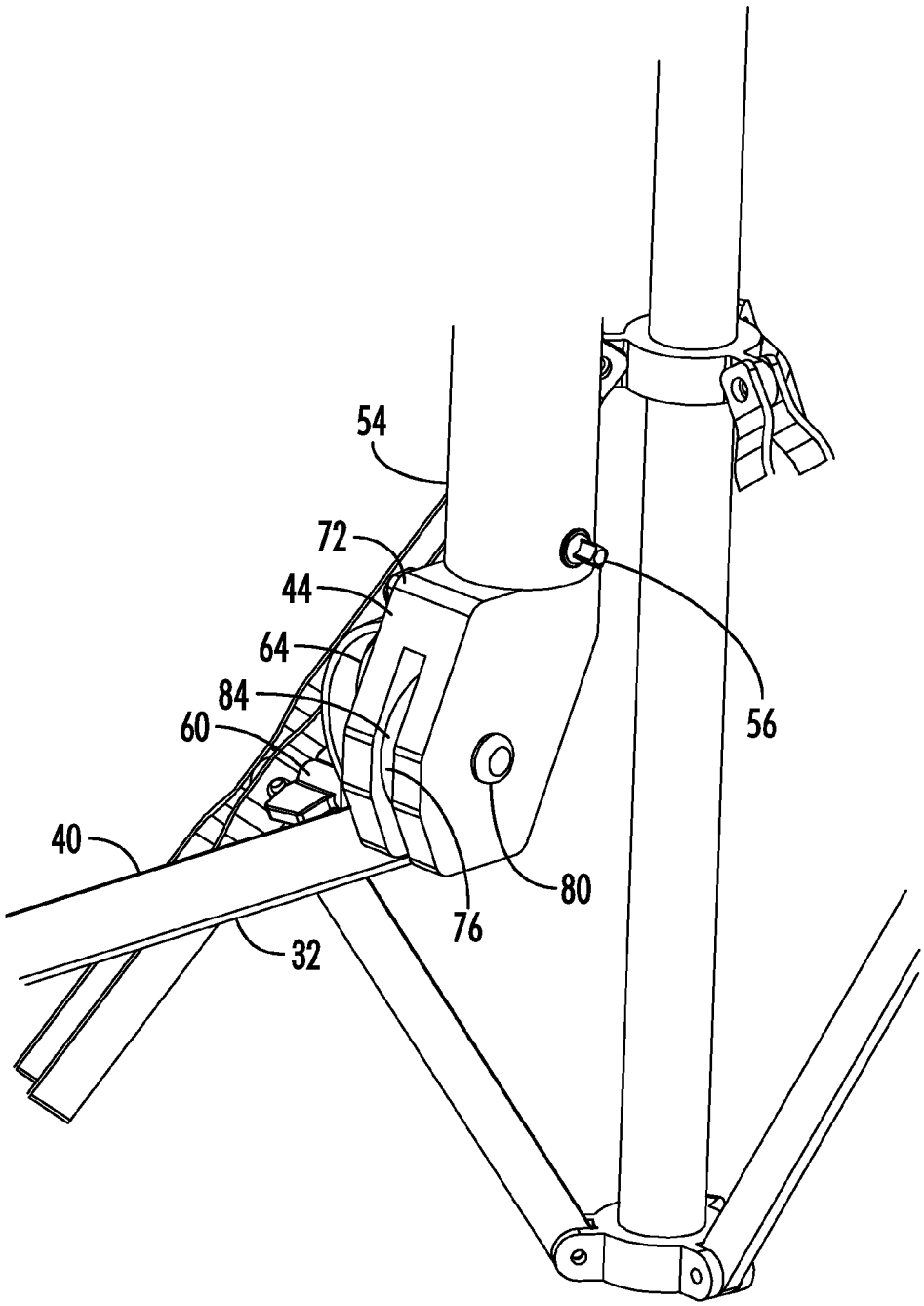
Figure 4C:
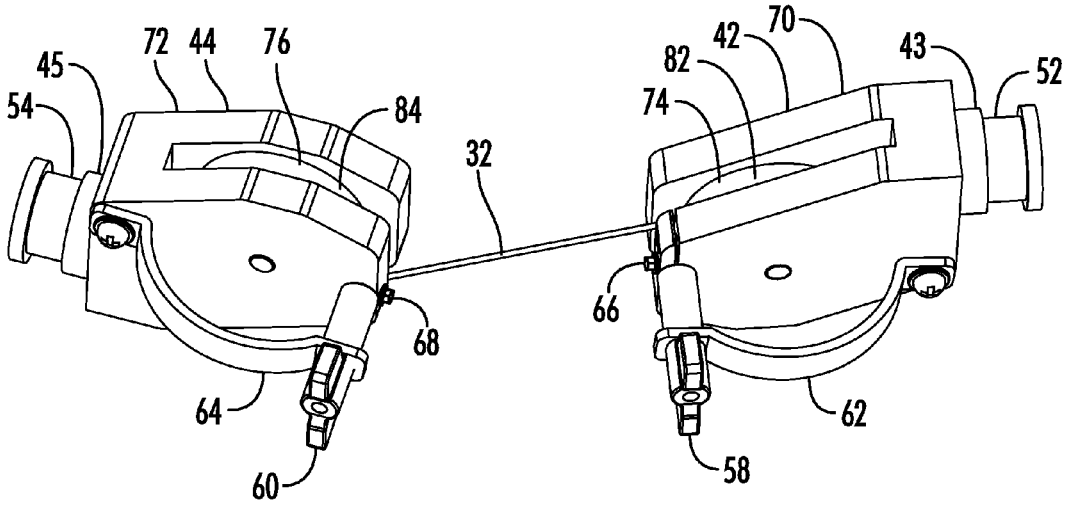
Figure 5A:
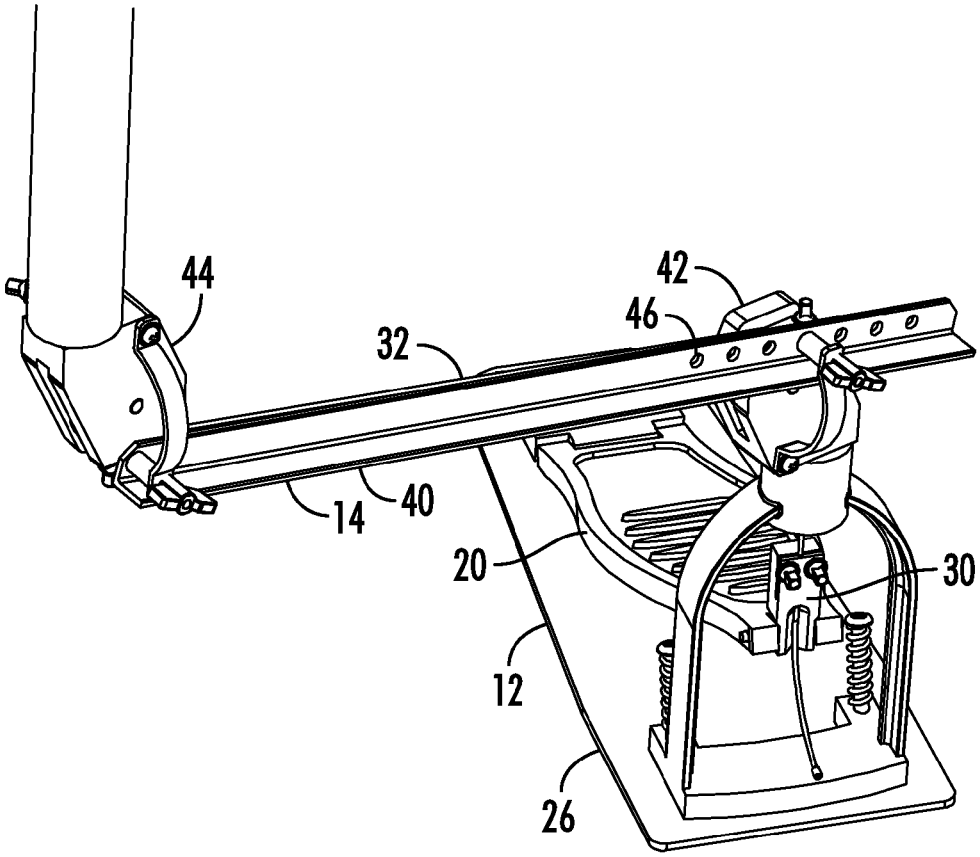
FIGS. 5*a-i* are illustrations of optional embodiments of braces of a remote activated percussion device of the present invention
Figure 5B:
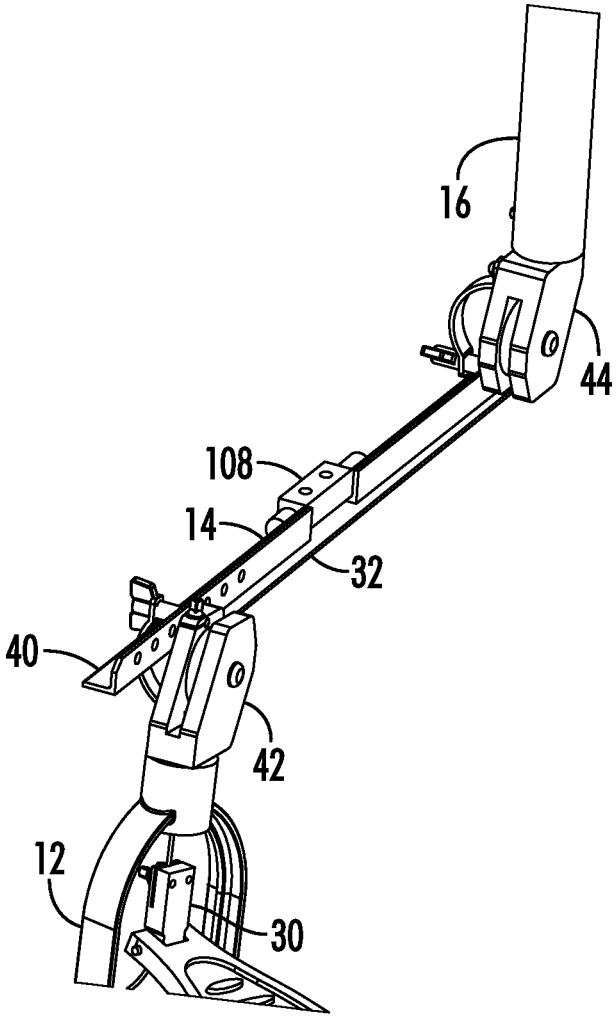
Figure 5C:
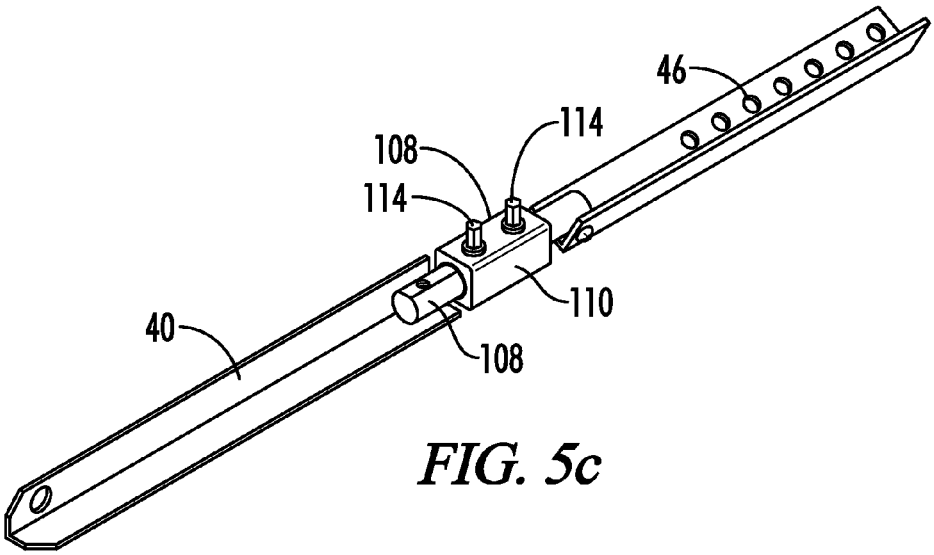
Figure 5D:
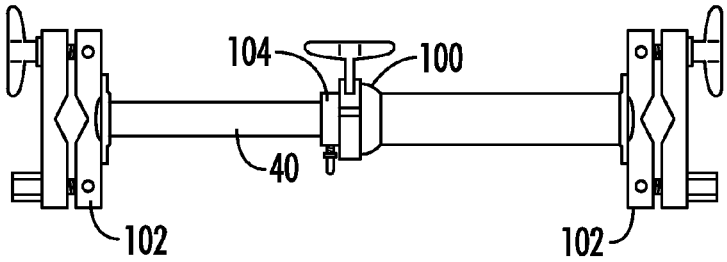
Figure 5E:
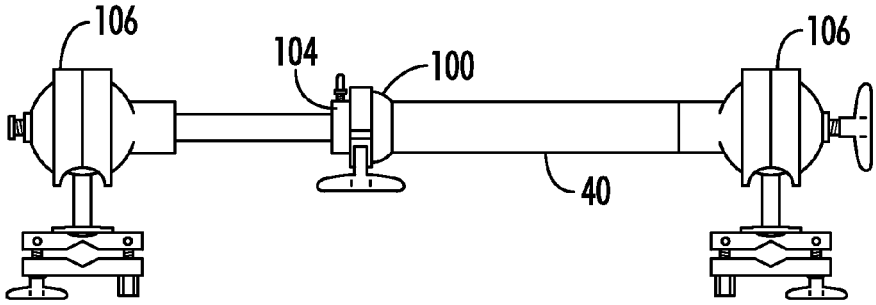
Figure 5F:
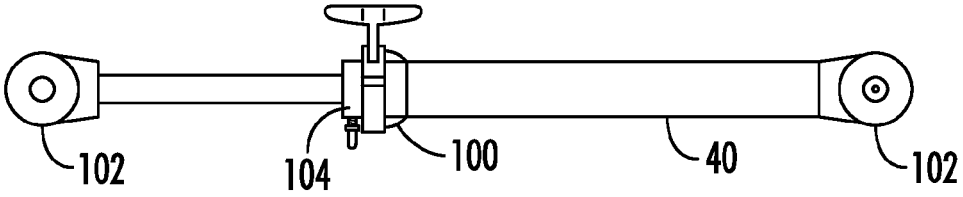
Figure 5G:
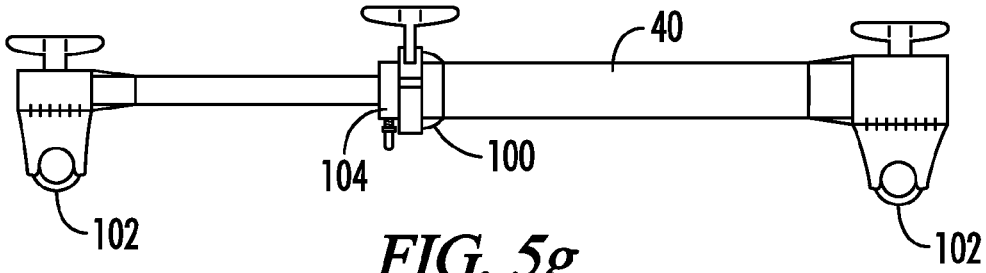
Figure 5H:
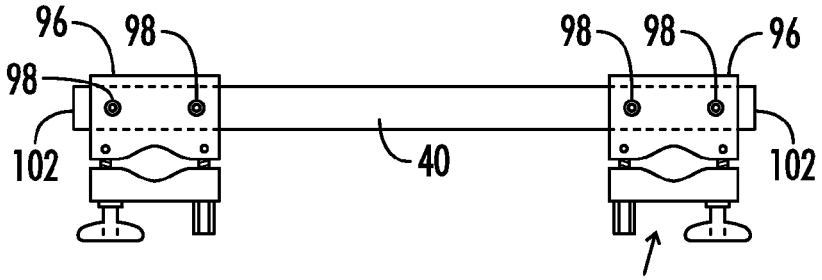
Figure 5I:
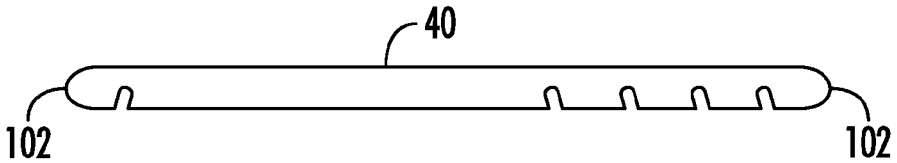
Figure 6:
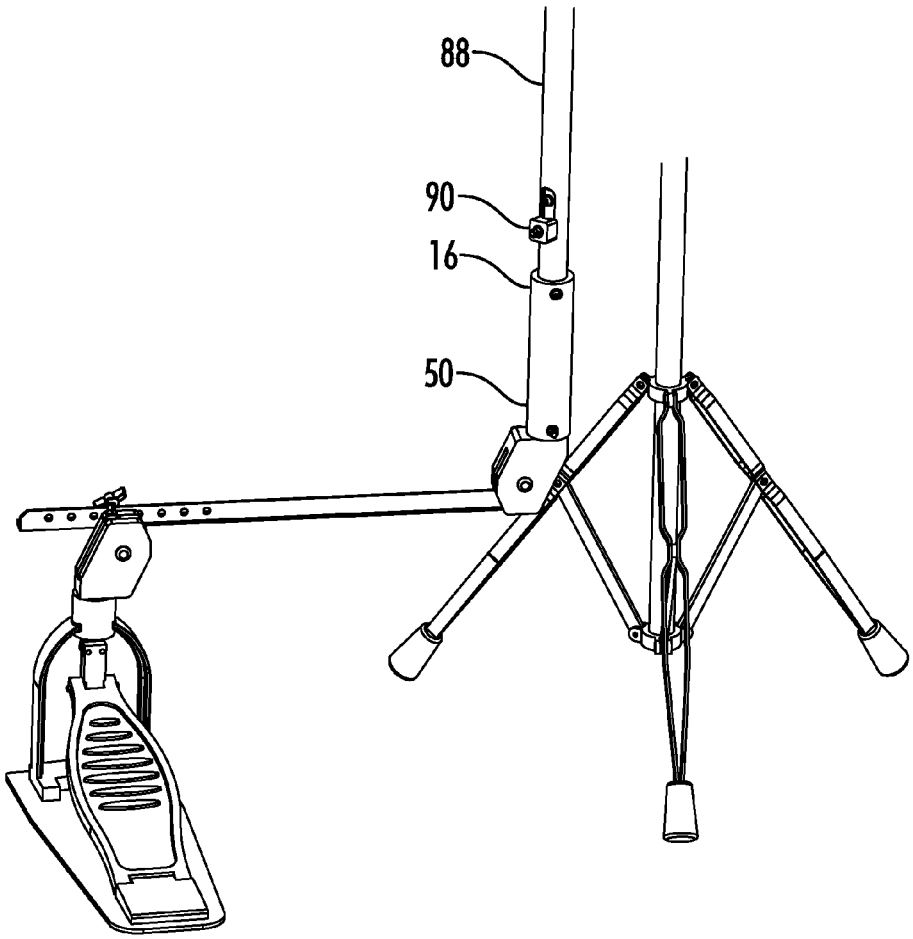
FIG. 6 is an illustration of optional embodiments of a support section of a remote activated percussion device of the present invention.
Figure 7:
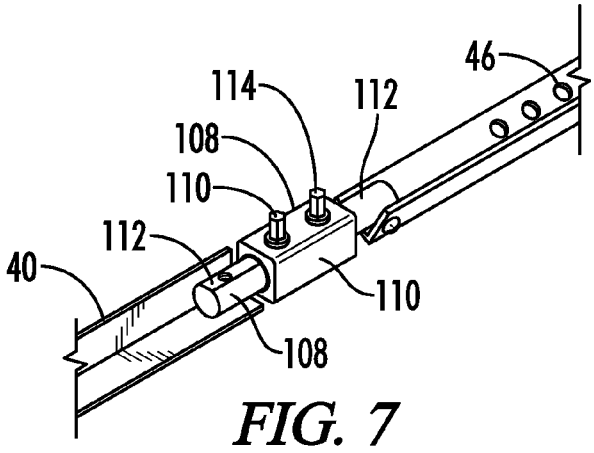
FIG. 7 is an illustration of an optional embodiment of a rotatable element of a brace of the remote activated percussion device of the present invention.
Figure 8A:
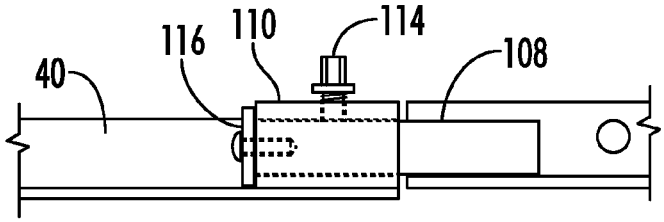
FIGS. 8*a-c* are illustrations of a further optional embodiment of a rotatable element of a brace of the remote activated percussion device of the present invention.
Figure 8B:
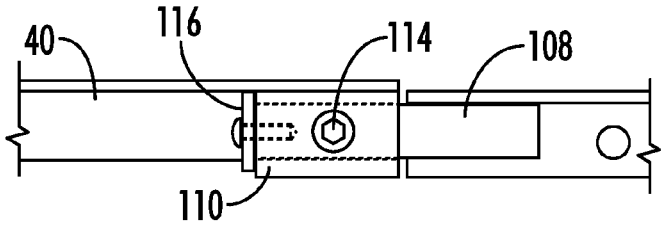
Figure 8C:
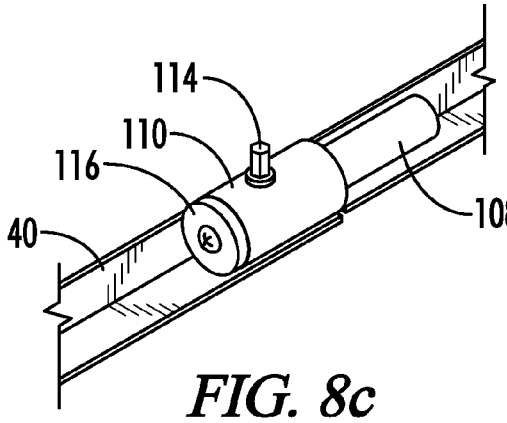

FIGS. 1*a-b* illustrate two views of an optional embodiment of remote activated percussion device 10 including pedal section 12, transfer section 14, and support section 16. As is observed from the figures, the foot pedal section 10 is not located directly beneath support section 16 but rather may be located remote distance 18 from the bottom of support section 16. Generally, conventional hi-hat arrangements do not include remote distance 18.

In optional embodiments, transfer section 14 may be positioned between pedal section 12 and support section 16, and provides for displacement of pedal cable attachment 24 of foot pedal 20 from support section axis 22, creating remote distance 18. Otherwise stated, remote distance 18 may be understood to be the displacement realized by the invention which allows for greater flexibility in positioning hi-hat cymbals. Optional embodiments of remote activated percussion device 10 include a remote distance 18 of from about three inches to about 72 inches, which generally correlates to the size of transfer section 14, among other dimensional considerations. Further optional embodiments provide for remote distance 18 in the range of from 8 inches to about 24 inches.

Pedal section 12 generally includes foot pedal 20, foot pedal base 26, foot pedal cable attachment 24 and pedal hinge 28. In operating, a user generally depresses foot pedal 20 causing foot pedal cable attachment 24 to move closer toward foot pedal base 26.

Foot pedal cable attachment 24 may include clamp 30 for grasping cable 32. In optional embodiments, cable 32 connects at clamp 30 of foot pedal attachment 24 and spans across transfer section 14 to support section 16. Clamp 30 may be of a variety of different styles including a screw with a hole for cable to feed within as well as compression devices where pressure is exerted on the cable to maintain clamping at a desired location on the cable.

An optional embodiment may include a clamp having clamp hole 34 within clamp 30 for cable 32 to feed within. Clamp 30 may also be movably connected to the toe portion of foot pedal 30. Cable 32 may have excess cable end 36 feed out of clamp 30 so as to allow for adjustability. Further optional embodiments include set screws 38 on clamp 30 for application of pressure to cable 32 within clamp 30. Set screws 38 may be operated by a drum key (not shown), a device used generally in tuning a drum which fits over the top of a lug that runs through the top or bottom rim of a drum shell. Clamp 30 may provide pressure on both sides of cable 32 and thus result in less crimping or weakening of the cable than other clamps that twist or directly apply pressure to a cable from a twisting screw. As used herein, the term "set screw" is defined as meaning a screw which may tighten against an object to hold that object or another in place, or alternatively, the term may refer to a screw or the like that is tightened to better maintain an object in place.

Through use of optional embodiments of clamp 30 of foot pedal cable attachment 24, a user may clamp and unclamp cable 32 many times with little adverse effects to the structural integrity of the cable. Furthermore, by providing an adjustment point for attaching to the cable, a user may allow for clamp 30 of foot pedal cable attachment 24 to be attached at various locations on the cable. This may allow for a user to position foot pedal 20 in a desired angle as the user could attach clamp 30 of foot pedal cable attachment 24 at a lower position on cable 24 to decrease the angle between foot pedal 20 and foot pedal base 26 or alternatively attach higher on cable 32 to increase the angle between foot pedal 20 and foot pedal base 26.

Additionally, while optional embodiments of the present invention may include a nonadjustable clamp, the use of the previously described adjustable clamp provides further for accounting for stretch of cable 32 which may occur with use of remote activated percussion device 10. Clamp 30 yet further provides for improved disassembly and assembly of remote activated percussion device 10. Where a user desires to adjust remote distance 18, a user can adjust clamp 30 holding cable 32 to allow for the desired remote distance and appropriate reconfiguration.

Transfer section 14 of remote activated percussion device 10 generally includes two or more transitions for cable 32 and brace 40. As used herein, "transition" is used interchangeably with "transition point" and may be understood to be the location where cable 32 changes directions. In optional embodiments, each transition includes a pulley element with an optional embodiment of the present invention including first pulley element 42 and second pulley element 44. As used herein, "pulley element" refers to any hardware that includes a pulley. This may include a housed pulley, bare pulley, or pulleys with clamps and connectors as is subsequently discussed. As such, pulley element can refer to different styles of pulleys attached in various manners to remote activated percussion device 10. Brace 40 is located between about pedal section 12 and support section 16 of remote activated percussion device 10 with cable 32 spanning along the length of brace 40.

In an optional embodiment of remote activated percussion device 10 cable 32 connects to foot pedal section 12 at foot pedal cable attachment 24, passed over first pulley element 42, spans the length of brace 40 and passes about second pulley element 44. In optional embodiments, pulley elements 42 and 44 may provide only minimal friction, thus allowing a significant percentage of the energy used to push down the foot pedal and thus pull the cable downward to transfer to the hi-hat cymbals.

In further optional embodiments, the transition points may not include pulley elements but rather may include other mechanical devices such as eyelets, simple rods or the like in communicating the cable between the foot pedal section and the cymbals.

Generally, activation of an optional embodiment of remote activated percussion device 10 includes a user applying downward pressure on foot pedal 20 of pedal section 12 thus causing clamp 30 holding cable 32 in a fixed position to also move downward in ultimately moving an upper cymbal of hi-hat cymbals downward to contact the lower cymbal.

Cable 32 may be understood to include any wire or flexible, relatively thin material that has sufficient strength for use in operation of a percussion device. Furthermore, as previously discussed in connection with remote distance 18, brace 40 of transfer section 14 may be of various lengths so as to provide user with various options for remote distance 18. In optional embodiments, brace 40 may include a plurality of adjustment points 46 so that the desired remote distance 18 can be achieved without having to rely only on interchanging one brace 40 for a brace 40 having a different length. Adjustment points 46 can include holes so that a user may connect the pulley elements at various locations on brace 40, thus dictating how far away foot pedal section 12 is located from the support section axis 22 in establishing remote distance 18. In optional embodiments, adjustment points 46 may include holes which may allow for the user to engage different holes based on the desired remote distance 18. Further optional embodiments may include angled notches, ridges, friction type connectors and the like so that the user may set a remote distance without having to change to a different brace.

In further optional embodiments, brace 40 may be designed with adjustment points 46 spaced at set increments that may range from about 0.5 inches to about 16 inches between adjacent adjustment points. In additional optional embodiments, adjustment points 46 may be holes created within brace 40 at about 1 inch increments. Pulley elements may engage the adjustment points in setting the desired remote distance.

Optional embodiments of brace 40 may be in a variety of lengths of from about three inches to about 72 inches, with additional optional lengths from about 18 inches to about 36 inches in length and about 10 inches to about 20 inches. Optional embodiments of brace 40 may be of any suitable thickness, so as to provide sufficient rigidity between pedal section 12 and support section 16 which may include variety of materials, including metals, alloys, plastics, polymers, woods and the like. Additionally, in further optional embodiments of brace 40, brace 40 may different cross-sections. Brace 40 may include an "L-shaped" cross section, or alternatively may be rectangular, square, circular, oval, or have a cross section of a variety of other shapes. In optional embodiments of the present invention, embodiments of brace 40 are advantageous as where one side is within a plane spanning from one end to the other end of brace 40, for example an "L-shaped", rectangular, square, or polygonal cross-section of brace 40. This may allow for each pulley element to fit flush against the same side of brace 40 when support section 16 is in an about vertical arrangement.

First pulley element 42 is generally understood to be the element that fits within pulley connection 48 on pedal section 12 and second pulley element 44 is generally understood to be the element that fits within pulley connection 50 of support section 16 of remote activated percussion device 10. First pulley element 42 includes connector 52 which may be similar to a post or the like. In optional embodiments, connector 52 fits within pulley connection 48, thus allowing pulley element 42 to be in connection with pedal section 12. In optional embodiments, connector 52 may be sized slightly smaller than pulley connection 48 so that first pulley element 42 may rotate within pulley connection 48 via connector 52. Pulley connection 48 may further include set screw 53 which can be used to set first pulley element 42 in a substantially fixed position and not allow first pulley element 42 to rotate within pulley connection 48.

Second pulley element 44 includes connector 54 that fits within pulley connection 50 of support section 16. Similarly to pulley element 42, second pulley element 44 may rotate as connector 54 may spin within pulley connection 50. Pulley connection 50 may optionally include set screw 56 so as to set or fix the position of second pulley element 44. In optional embodiments of remote activated percussion device 10, the set screws 53 and 56 may be designed to be tightened by a drum key, or in further optional embodiments may be tightened by allen wrenches, screwdrivers or the like.

Pulley elements 42 and 44, in optional embodiments, may also include pulley brace connectors 58 and 60 which may be used to attach each pulley element to brace 40. In optional embodiments, pulley brace connectors 58 and 60 may include a wingnut type design also referred to as a thumb tightenable design, or may be of a screw type design, which may require a drum key or screwdriver or other tool to tighten. Otherwise defined, pulley brace connectors 58 and 60 can be any mechanical connection used to maintain pulleys in contact with brace 40. Whereas connectors 50 and 52 of the pulley elements are utilized for connecting to pedal section 12 and support section 16, pulley brace connectors 58 and 60 are utilized to connect pulley elements 42 and 44 to brace 40. In further optional embodiments, tethers 62 and 64 may attached each pulley brace connector flexibly to its pulley element so as to better avoid losing the connectors. Tethers 62 and 64 may be made of leather, cloth, polymer fabric, chain, string, or any other flexible material that can maintain the pulley brace connectors to their respective pulley element.

In further optional embodiments, pulley elements 42 and 44 many further include connector clamps 66 and 68 to further secure pulley brace connectors 58 and 60 so that there is a lesser likelihood of the connectors working loose while playing the drums. Generally, connector clamps 66 and 68 may include a screw type design or the like and may also be designed to tighten with a drum key or other tool or the like. Often, connector clamps 66 and 68 are tightened after remote activated percussion device 10 is assembled, prior to playing the drums.

In optional embodiments of pulley elements 42 and 44, each pulley element may have a retention groove 43 or 45, a groove generally on each pulley connector 52 and 54. Grooves 43 and 45 provide a place on the circumference on the pulley connectors for the set screws to partially insert. This allows an individual to insert a pulley connector into ether the connection on the support section or the pedal section, subsequently partially tighten the set screw on the connection to a degree so that the connector can still rotate, but is retained within the connection. This may assist in the assembly of the remote activated percussion device.

Optional embodiments of pulley elements 42 and 44 include pulley wheel housings 70 and 72, pulley wheels 74 and 76, and pulley shafts 78 and 80. Pulley wheel housings 70 and 72 maintain pulley wheels 74 and 76 there within each housing about each respective pulley shafts 78 and 80. In optional embodiments, pulley wheels 74 and 76 may include cable grooves 82 and 84. Cable grooves 82 and 84 generally may be shaped so as to receive and maintain cable 32. Pulley wheels 74 and 76 may be formed of a variety of materials including metals and also plastics and polymers which may provide for little friction. Optional embodiments of pulley wheels 74 and 76 include Delrin which is a stiff, low friction, thermoplastic.

Support section 16 is generally understood to be the aspect of remote activated percussion device 10 that maintains hi-hat cymbals 86. As previously discussed, support section 16 includes pulley connector 50 for connection with second pulley 44 and also includes hollow support shaft 88. Within hollow support shaft 88, cable 32 is positioned and ultimately connects to internal rod 94 which is in communication with hi-hat cymbals 86. Internal rod 94 may extend partially within hollow support shaft 88 and generally extends about 80 percent to about 10 percent the internal length of hollow support shaft 88 with one end in communication with cymbals 86. In further optional embodiments, cable 32 may extend more or less within the length of hollow support shaft 88. Support shaft 88 may also be clamped to an existing stand or portion of a drum kit.

In additional optional embodiments, support section 16 may include adjustable spring tensioner 90. Adjustable spring tensioner 90 allows a user to change the tension on an internal spring (not shown) that provides resistance to separate the two hi-hat cymbals 86 and also provides the necessary resistance in activating cymbals by foot pedal 20. Adjustable spring tensioner 90 allows for various weights and diameters of cymbals to be utilized and for a user to adjust the tension on the spring which correlates to the recoil and activation time for the cymbals.

In FIG. 1*a-b*, the interconnection between support section 16, transfer section 14 and pedal section 12 is illustrated. At one end, cable 32 connects at clamp 30 of foot pedal cable attachment 24 which is attached to foot pedal 20 of pedal section 12. First pulley element 42 is attached to pulley connection 48 on pedal section 12 with cable 32 engaging pulley wheel 74 within pulley wheel housing 70. First pulley element 42 is attached to brace 40 via pulley connector 58 and cable 32 spans from first pulley element 42 to pulley wheel 76 within pulley wheel housing 72 of second pulley element 44. Second pulley element 44 connects to brace 40 via pulley connector 58 and also connects to pulley connection 50 of support section 16. Cable 32, after engaging second pulley element 44 enters hollow support shaft 88 and connects to internal rod 94 for operation of cymbals 88, held apart by the spring controlled by adjustable spring tensioner 90.

In assembling remote activated percussion device 10, a user inserts first pulley connector 50 of first pulley element 42 into pulley connection 48 on foot pedal section 10, tightening set screw 53 at least enough to maintain first pulley element 42 within pulley connection 48 but still allowing first pulley element 42 to spin within pulley connection 48. The user also inserts second pulley connector 54 of pulley element 44 into pulley connection 50 and also may tighten set screw 56 enough to maintain second pulley element 44 but allow pulley element 44 to spin within pulley connection 50. The user then may place pedal section 12 in the desired location for ease of play of foot pedal 20 and also may position support section 16 in a desired location, generally by clamping around hollow support shaft 88.

The user then may swivel pulley elements 42 and 44 in their respective pulley connections 48 and 50 so that the pulley elements are facing one another. Brace 40 may then be positioned to pulley elements 42 and 44 and connected by pulley brace connectors 58 and 60. The user may select the proper adjustment points 46 for the pulley elements 42 and 44. Generally, in optional embodiments, the end of brace 40 is attached to second pulley element 44 and first pulley element 42 is attached at one of attachment points 46 on brace 40. In optional embodiments, this orientation may be changed. After positioning, the user can tighten pulley brace connectors 58 and 60 to better secure the orientation of remote activated percussion device 10. A user may then set foot pedal 20 at the desired height while pulling on cable 32 which may be connected to internal shaft 94, passes down through hollow shaft 88, around pulley wheel 76 of second pulley element 44 and around pulley wheel 74 of first pulley element 42. In setting foot pedal 20, cable 32 is pulled to remove excess slack but not the internal spring of hi-hat cymbals 86 and fixed in clamp 30 of pedal cable attachment 24 to foot pedal 20. In optional embodiments including connector clamps 66 and 68, a user may then tighten connector clamps 66 and 68 to even more securely maintain pulley brace connectors 58 and 60. In further optional embodiments, a user may manipulate adjustable spring tensioner 90 to set the device base on the user's desires and the cymbal weight.

In further optional embodiments of the invention, cable 32 may connect directly to cymbals 86 or directly engage a spring inside of shaft 88 and thus internal 94 may be absent.

In additional optional embodiments the pulley elements may be understood as being affixed either permanently or removably either the support section, pedal section or both. In such instances, brace 40 may interact direct with either the support section, pedal section or both. This is merely another optional embodiment of the invention. In assembling such an embodiment, the user positions both the support section and pedal section and engages the brace section to provide the desired remote distance. Further as used herein, even with the pulley elements described within the transfer section, pulley elements either permanently attached or removably attached to the pedal section and support section would be considered in the same manner as the pulleys are utilized in transferring the direction of the cable at transition points.

In further optional embodiments, the pulley elements may include connectors so as to adapt to additional styles of stands and or foot pedals so to possibly be able to adapt a user's hardware in a different arrangement. As such, the connectors may be of a variety of shapes, sizes and lengths and can be optionally adapted to a wide variety of drumming hardware.

In additional optional embodiments of brace 40 may have a notch design, including both the width and the depth, and may be adjusted for a variety of different screws and wingnuts, posts or other types of hardware that may be placed with within the notches and structure the at least two transition points of the percussion device.

Further embodiments of transfer section 14 may include brace 40 engaged with sliding clamps 96 with set screws 98 that may be adjusted about brace 40 providing for a variety of lengths in configuring transfer section 14. In such optional embodiments, sliding clamps 96 may be adjusted so that remote distance 18 may be altered. In such optional embodiments, pulleys (not shown) may be attached to sliding clamps 96 to provide for the transition points for cable 32 in transferring energy from foot pedal 40 to the hi-hat cymbals. Pulleys may be attached to sliding clamps 96 in a variety of ways including pressure fits, screw fits, friction fits, snap-type attachments, as well as removable and non-removable connection styles. In yet further embodiments not illustrated, pulleys may be affixed permanently to sliding clamps 96.

Additional optional embodiments of transfer section 14 may include brace 40 with length adjuster 100 to provide for a brace that varies in length. In such embodiments, pulleys or the like may be attached at the ends 102 of brace 40. Ends 102 may include clamps or the like as well as other items for the attachment of pulley elements thereto or for securing to either the pedal section or the support section. In further optional embodiments, length adjuster 100 may also include memory lock 104 where one portion of the brace has a small diameter that may lockingly slide within a portion of the brace having a larger inner diameter. Memory lock 104 may include various types of locks known within the art as well as set screws, holes and pegs, thread-type arrangements and even securement pins, so that brace 40 may be adjusted and set at a specific length. Ends 102 may include openings for posts having a diameter of from about ⅜ inches or about 9.5 millimeters, wherein a user may connect pulleys thereto.

Additional optional embodiments of brace 40 may include brace 40 with rotatable element 108. Rotatable element 108 may allow for brace 40 to have one end rotate relative to the other end. In instances where a user plans to have their hi-hat cymbals tilted, rotatable element 108 still allows for brace 40 to remain flush against the pulley elements. More specifically, in instances where brace 40 has an "L-shaped" cross-section, each pulley element can lay flush against the vertical side of brace 40 when both pulley elements are oriented in a substantially vertical direction. However, in instances where a user desires for the hi-hats to be tilted, the second pulley element would be also at an angle and thus not able to fit flush against a vertical side of a brace. With rotatable element 108, one end of the brace can twist in reference to the other end of the brace and thus the second pulley element can flushly fit against the brace. In further optional embodiments, the first pulley element may be in a vertical arrangement, as it connects to the pedal section and the second pulley element may be angled in an orientation that is not vertical and thus, the rotatable element allows the end of brace 40 nearest to the second pulley element to twist so that a side of brace 40 is substantially parallel to the second pulley element.

In further optional embodiments, rotatable element 108 may include outer fixed element 110 and inner rotatable element 112 as well as one or more set screws 114. Inner rotatable element may rotate within outer fixed element 110 with the end of inner rotatable element fixed to at least one side of the brace. In optional embodiments, there may be two inner rotatable elements, each affixed to one side of the brace and both allowed to rotate within inner rotatable element, where typically two set screws will be used. In additional optional embodiments, other fixed element will be attached to one side of brace 40 and the inner rotatable element will be affixed to the other end of brace 40, and may extend completely through outer rotatable element. In such embodiments, one or more set screws may be used to secure the orientation of each end of the brace when one has the desired orientation. End cap 116 may also be utilized to secure inner rotatable element within outer fixed element.

In yet even further optional embodiments of transfer section 14 brace 40 may include ball-socket type ends 106 to provide rotation in providing even greater flexibility in arranging the support section and pedal section of the present invention. The ball-socket type ends 106 may allow a user to rotate each end and thus also allow for a tilted hi-hat arrangement. In further optional embodiments, ball-socket type end 106 may be available at one or both sides of brace 40. In such optional embodiments, a user may attach a pulley directly to the ball-socket type end 106 through any number of methods of attachment as discussed herein this disclosure.

In yet even further optional embodiments, simple clamps may be used at each end of an adjustable brace for the securing of a transition point thereto. This may include the previously disclosed pulley type design for attachment or other types of transition points that may be dictated by the cost and design characteristics of the specific embodiment of the novel apparatus of the present invention.

In addition optional embodiments of the pulley elements described previously, various additional and optional pulleys elements may be clamped or attached to the additional embodiments of brace 40. As previously mentioned, pulleys may provide the transition points for the cable which include a shift in direction or orientation. For example, an optional embodiment could include two pulleys with cable 32 transitioning from about parallel to a vertical axis from at clamp 30 of foot pedal 20 to an axis closer to horizontal, and there after transitioning to about parallel to a vertical axis at the subsequent pulley where about cable 32 enters support section 16 and connects to the hi-hat cymbals.

In further optional embodiments, depending upon the heights and orientations of the support section, transition section and pedal section, orientations may completely vary; it is not beyond the scope of the invention for the foot pedal to be located even higher than the point at where the transfer section connects to the support section of the invention. Furthermore, additional optional embodiments of the invention may include more than two pulleys.

The remote activated percussion device includes activation and recoil times of very short durations as the pulleys allow for efficient transfer of energy. Furthermore, finesse and musical dynamics greater than obtainable by prior art hi-hat arrangements may be possible. The invention provides for activation of hi-hat cymbals that requires only a light touch of the foot pedal, while also allowing for a significant portion of the drummer's energy in striking the pedal to be transferred to the cymbals. The timing of the remote activated percussion device may also be maintained in a manner typical to traditional hi-hat arrangements, while also providing for an increased freedom of the drummers hands as the hi-hat cymbals can be located in different arrangements.

The invention of the above captioned application may allow for a user to set up the foot pedal immediately adjacent to other pedals, including a double bass pedal, so that the brace of the novel invention may not be obstructed by the other pedals in close proximity.

The present invention may provide for an increased freedom in playing the drums as the hi-hat cymbals may be located in such a manner so that a drummer would not have to their right hand over their left hand in striking the cymbals. As almost all drummers, drum in a right-handed manner (with almost all drum kits set for a right-handed drummer), the invention allows for the hi-hat cymbals to be placed so that the right-hand of the drummer is not required to cross over the left hand to play the hi-hat, thus leaving the left hand more freedom to play with a full range of motion. Additionally, the hi-hat apparatus of the present invention may be placed in a more desirable location, while still being accessible, such that the drummer's left side may have new space for other percussive instruments. The resulting change may allow for the possibility of new musical dynamics and drumming arrangements.

Furthermore, sizes of various structural parts and materials used to make the above mentioned components are illustrative and exemplary only, and persons of ordinary skill in the art would recognize that these sizes and materials can be changed as necessary to produce different results or different desired characteristics.

The above description is intended to enable the person skilled in the art to practice the invention. It is not intended to detail all of the possible variations and modifications that become apparent to the skilled worker upon reading this description. It is intended however that all such modifications and variations be included within the scope of the invention and that is defined by the following claims. The claims are intended to cover the indicated elements and steps in any arrangement or sequence that is affective to meet the objectives intended for the invention, unless the context specifically indicates the contrary.

What is claimed is:

1. A remote activated percussion device comprising:

a pedal section having a foot pedal and a connection for a pulley element;

a support section having an at least partially hollow shaft and a connection for a pulley element, the support section for supporting a pair of cymbals;

a transfer section having a brace, a first pulley element and a second pulley element;

the brace providing a remote distance and spanning at least between the first pulley element and the second pulley element;

the first pulley element having a connector for connecting to the connection for a pulley element on the pedal section and the first pulley element having a brace connector;

the second pulley element having a connector for connecting to the connection for a pulley element on the support section and the second pulley element having a brace connector;

a cable engaging the pedal section, transfer section and support section for activating the pair of cymbals;

a drum key tightenable clamp for engaging the cable; and wherein the remote distance displaces the foot pedal section from the support section.

2. The percussion device of claim 1 wherein the connection for a pulley on the pedal section further comprises a set screw for securing the first pulley.

3. The percussion device of claim 1 wherein the support section comprises an internal shaft for engaging the cable.

4. The percussion device of claim 1 wherein the support section comprises a spring for engaging the pair of cymbals.

5. The percussion device of claim 1 further comprising an adjustable spring tensioner for adjusting performance characteristics of the device.

6. The percussion device of claim 1 wherein the brace comprises adjustment points for locating at least one of the first and second pulleys.

7. The percussion device of claim 1 wherein the brace is length adjustable.

8. The percussion device of claim 1 wherein the brace is up to about 72 inches in length.

9. The percussion device of claim 1 wherein the brace is from about three inches to about 72 inches in length.

10. The percussion device of claim 1 wherein the remote distance is from about three inches to about 72 inches.

11. The percussion device of claim 1 wherein the remote distance is from about six inches to about 24 inches.

12. The percussion device of claim 1 wherein at least one of the pulley elements comprise a brace connector clamp.

13. A remote activated percussion device comprising:

a pedal section having a foot pedal, a connection for a pulley element and a drum key tightenable cable clamp;

a support section having an at least partially hollow shaft, a connection for a pulley element and an adjustable spring tensioner, the support section for supporting a pair of cymbals;

a transfer section having a brace, a first pulley element and a second pulley element;

the brace providing a remote distance and having adjustment points;

each pulley element including a pulley wheel with a groove and comprised of a polymer;

the first pulley element having a connector for connecting to the connection for a pulley element on the pedal section and the first pulley element having a brace connector;

the second pulley element having a connector for connecting to the connection for a pulley element on the support section and the second pulley element having a brace connector, and a cable engaging the cable clamp of the pedal section, the first pulley element and the second pulley element of the transfer section and connecting within the at least partially hollow shaft of the support section;

the cable for activating the pair of cymbals upon application of force to the foot pedal;

the foot pedal separated from the connection for the pulley element on the support section by the remote distance of from about 3 inches to about 72 inches.

14. The percussion device of claim 13 wherein the configuration of the first pulley element and the second pulley element with the brace provides for different remote distances.

15. A remote activated percussion device comprising:

a pedal section having a foot pedal, a connection for a pulley element, and a drum key tightenable clamp for engaging a cable;

a support section having an at least partially hollow shaft and a connection for a pulley element, the support section for supporting a pair of cymbals;

a transfer section having a brace, a first pulley element and a second pulley element;

the first pulley element having a connector for connecting to the connection for a pulley element on the pedal section and the first pulley element having a brace connector;

the second pulley element having a connector for connecting to the connection for a pulley element on the support section and the second pulley element having a brace connector; and the cable engaging the pedal section, transfer section and support section for activating the pair of cymbals.

* * * * *